US009345272B2

(12) United States Patent
Hurd

(10) Patent No.: US 9,345,272 B2
(45) Date of Patent: May 24, 2016

(54) SPORT BRA WITH MOISTURE-TRANSPORTING MOLDED CUPS

(71) Applicant: Nike, Inc., Beaverton, OR (US)

(72) Inventor: Rebecca P. Hurd, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 443 days.

(21) Appl. No.: 13/833,683

(22) Filed: Mar. 15, 2013

(65) Prior Publication Data

US 2013/0316615 A1 Nov. 28, 2013

Related U.S. Application Data

(60) Provisional application No. 61/651,663, filed on May 25, 2012.

(51) Int. Cl.

| | |
|---|---|
| ***A41C 3/14*** | (2006.01) |
| ***A41C 3/00*** | (2006.01) |
| ***A41C 5/00*** | (2006.01) |

(52) U.S. Cl.

CPC ..... *A41C 3/0057* (2013.01); *A41C 3/14* (2013.01); *A41C 5/005* (2013.01); *A41D 2400/62* (2013.01)

(58) Field of Classification Search

CPC ..... A41C 3/00; A41C 1/00
USPC ..... 450/64–67, 70, 74–76, 78, 81, 82, 92, 450/93

See application file for complete search history.

(56) References Cited

U.S. PATENT DOCUMENTS

| | | | | |
|---|---|---|---|---|
| 3,301,798 | A | 1/1967 | Waterman | |
| 3,348,549 | A | 10/1967 | Brodmann et al. | |
| 5,269,720 | A * | 12/1993 | Moretz et al. | 450/37 |
| 5,873,768 | A | 2/1999 | Fleischman-Ament et al. | |
| 5,967,877 | A | 10/1999 | Howard | |
| 8,143,472 | B1 | 3/2012 | Bragd et al. | |
| 2002/0050667 | A1 | 5/2002 | Swartz et al. | |
| 2004/0168479 | A1 * | 9/2004 | McMurray | 66/202 |
| 2005/0188470 | A1 * | 9/2005 | Li et al. | 8/115.51 |
| 2005/0255789 | A1 * | 11/2005 | Gaudet et al. | 450/41 |
| 2007/0097151 | A1 * | 5/2007 | Rosenberg | 345/660 |

FOREIGN PATENT DOCUMENTS

| | | |
|---|---|---|
| EP | 1721720 | 11/2006 |
| EP | 2245949 A1 | 11/2010 |

OTHER PUBLICATIONS

International Preliminary Report on Patentability dated Nov. 25, 2014 in Application No. PCT/US2013/042346, 14 pages.

(Continued)

*Primary Examiner* — Gloria Hale
(74) *Attorney, Agent, or Firm* — Shook, Hardy & Bacon L.L.P.

(57) ABSTRACT

Different molding materials and methods are provided for producing a sport bra having moisture-transporting molded bra cups. The different molding materials comprise foams having different average cell sizes, fibers having different average deniers per filament, injection-molding materials having different degrees of hydrophilicity, and different hydrophilic treatments. The molding materials are arranged to create a hydrophilic gradient from a skin surface of the wearer of the sport bra to the exterior of the sport bra.

42 Claims, 6 Drawing Sheets

(56) References Cited

OTHER PUBLICATIONS

Notification of Transmittal of the International Search Report and the Written Opinion of the International Searching Authority, or the Declaration in PCT/US13/42346 mailed Oct. 9, 2013, 144 pages.

Tsang: A Study of Foam Yellowing Performance for Bra Cup Moulding and End Uses. The Hong Kong Polytchnic University 2010 [retrieved on Sep. 27, 2013]. Retrieved from the internet: <URL: http://www.itc.polyu.edu.hk/UserFiled/access/Files/BA/FYP0910/14090/08544833D.pdf>.

Tsang: A Study of Foam Yellowing Performance for Bra Cup Moulding and End Uses. Institute of Textiles and Clothing, The Hong Kong Polytechnic University 2010. Retrieved from the Internet on Oct. 7, 2015 at: http://scholar.googleusercontent.com/scholar?q=cache:Ei-8sijIPJ4J:scholar.google.com/&h.

European Search Report dated Dec. 4, 2015 in Application No. 13794361.9, 6 pages.

* cited by examiner

SPORT BRA WITH MOISTURE-TRANSPORTING MOLDED CUPS

CROSS-REFERENCE TO RELATED APPLICATION

This application claims the benefit of priority to U.S. Provisional Application No. 61/651,663 filed May 25, 2012 and entitled "Sport Bra With Moisture-Transporting Molded Cups." The entirety of this application is incorporated by reference herein.

FIELD

The present disclosure relates to moisture management apparel for wear during exertion. Specifically, the present disclosure relates to a molded cup used in a sport bra that has moisture-transporting properties.

BACKGROUND

Sweat evaporation from a person's skin is an important cooling mechanism during exertion. Oftentimes however, athletic apparel fails to effectively move sweat away from the person's skin which impairs the body's cooling mechanism and results in uncomfortable, sweat-saturated garments next to the person's skin.

One problem of particular note for females is the lack of a sport bra with a flexible, molded cup that effectively moves sweat away from the female's body. Sport bras are typically composed of some type of elasticized fabric; the fabric is elasticized in an attempt to provide some degree of support. The elasticized fabric may have moisture management characteristics, but the lack of a molded cup has its disadvantages. For example, unmolded bras provide less support than bras with molded cups. Further, unmolded bras generally have less modesty coverage than bras with molded cups. When molded cups are used in sport bras, the material used for the cups commonly lacks moisture-transporting properties, which means that sweat is not effectively moved away from the skin of the person wearing the sport bra.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, the present invention is directed toward a sport bra having moisture-transporting molded cups. The molded cups may be comprised of different materials having moisture-transporting properties. For example, the molded cups may comprise a foam having different zones, each zone having a different average cell size. The zones are arranged to facilitate movement of moisture away from the wearer's skin to the exterior surface of the sport bra. In another example, the molded cups may comprise moldable, non-woven fibers. Fibers having a larger average diameter or denier per filament are arranged closer to the wearer's skin, and fibers having a smaller average denier per filament are arranged closer to the exterior of the sport bra. This arrangement facilitates movement of sweat away from the wearer's skin.

In yet another example, the molded cups may comprise a water-permeable injection-molded material that, after injection molding, is treated with a hydrophilic material on the external surface of the cup. This creates a hydrophilic gradient across the cup from inside to outside that causes moisture to be transported away from the skin. In another aspect, the molded cups may comprise different layers of injection-molded materials with each layer having a different hydrophilicity. The layers are structured so that the less hydrophilic layer is closest to the wearer's skin and the more hydrophilic layer is located on the exterior surface of the cup. Like above, this creates a hydrophilic gradient that moves sweat away from the wearer's skin.

In an additional example, the molded cups may comprise a plurality of yarns, including tie-yarns that extend from an internal-facing fabric layer to an external-facing fabric layer, that create a hydrophilic gradient across the cup from the inside to the outside that causes moisture to be transported away from the skin. Continuing, another example includes molded cups that may comprise a spacer fabric made up of man-made and/or natural fibers. The different materials discussed above (foams, moldable fibers, yarns, spacer fabric, hydrophilic layers, and injection-molded materials) may be combined in multiple, different ways to create molded cups having different properties but all configured to transport moisture away from the wearer's skin.

BRIEF DESCRIPTION OF THE DRAWINGS

Examples are described in detail below with reference to the attached drawing figures, wherein.

DETAILED DESCRIPTION

Figure 1:
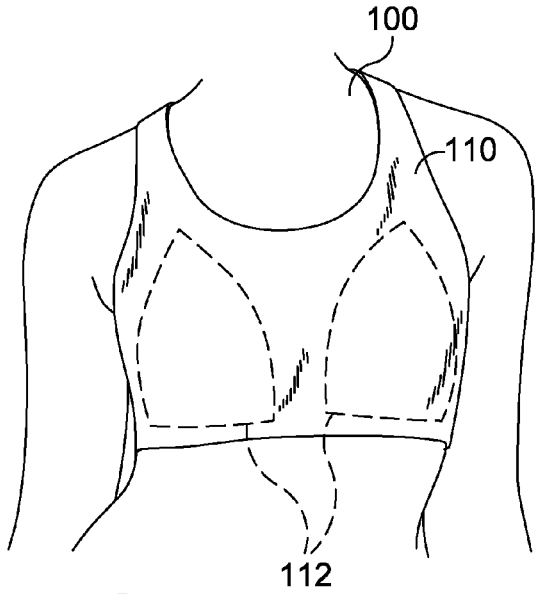
FIG. 1 depicts a sport bra with molded cups in an as-worn position in an aspect of the present invention.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, the present invention is directed toward a sport bra having moisture-transporting molded cups. The molded cups may be comprised of different materials having moisture-transporting properties. For example, the molded cups may comprise a foam having different zones, each zone having a different average cell size. The zones are arranged to facilitate movement of moisture away from the wearer's skin to the exterior surface of the sport bra. In another example, the molded cups may comprise moldable, non-woven fibers. Fibers having a larger average diameter (e.g., thicker fibers) are arranged closer to the wearer's skin, and fibers having a smaller average diameter (e.g., thinner fibers) are arranged closer to the exterior of the sport bra. The thickness or thinness of a fiber may be defined by a measure of fiber fineness such as, for example, denier per filament (DPF) where a larger DPF (e.g., a DPF greater than 1.04) is associated with a thicker fiber and a smaller DPF (e.g., a DPF less than 1.04) is associated with a thinner fiber. This arrangement facilitates movement of sweat away from the wearer's skin.

In yet another example, the molded cups may comprise a water-permeable injection-molded material that, after injection molding, is treated with a hydrophilic material on the external surface of the cup. This creates a hydrophilic gradient across the cup from inside to outside that causes moisture to be transported away from the skin. In another aspect, the molded cups may comprise different layers of injection-molded materials with each layer having a different hydrophilicity. The layers are structured so that the less hydrophilic layer is closest to the wearer's skin and the more hydrophilic layer is located on the exterior surface of the cup. Like above, this creates a hydrophilic gradient that moves sweat away from the wearer's skin.

In an additional example, the molded cups may comprise a plurality of yarns, including tie-yarns that extend from an internal-facing fabric layer to an external-facing fabric layer, that create a hydrophilic gradient across the cup from inside to outside that causes moisture to be transported away from the skin. Continuing, another example includes molded cups that may comprise a spacer fabric made up of man-made and/or natural fibers. The different materials discussed above (foams, moldable fibers, yarns, spacer fabric, hydrophilic layers, and injection-molded materials) may be combined in multiple, different ways to create molded cups having different properties but all configured to transport moisture away from the wearer's skin.

FIG. 1 illustrates a person 100 wearing a sport bra 110 with moisture-transporting molded cups 112 made of a molded material. As used throughout this application, the term "molded" means conforming to a predetermined shape but yet maintaining a degree of flexibility necessary for free movement of the wearer. The cups may be formed or molded using the application of heat in a heat press, injecting materials into a cavity, etc. Although FIG. 1 illustrates the sport bra 110 as having two separate molded cups 112, other arrangements are contemplated. For example, the molded cups 112 may be formed from a single piece of material that extends across the front of the person 100. In another aspect, the entire sport bra 110 may be made of the molded material. In yet another aspect, different areas of the sport bra 110 may be comprised of the molded material in addition to the molded cups 112. Further, the sport bra 100 may have different configurations or designs (racerback, convertible, front-closure, strapless, underwire, and the like). The sport bra 100 may be made of a variety of different man-made or natural fibers. Exemplary natural fibers comprise cotton, silk, wool, flax, and/or hemp, and exemplary man-made materials comprise polyester, nylon, rayon, spandex, and rubber.

Figure 2:
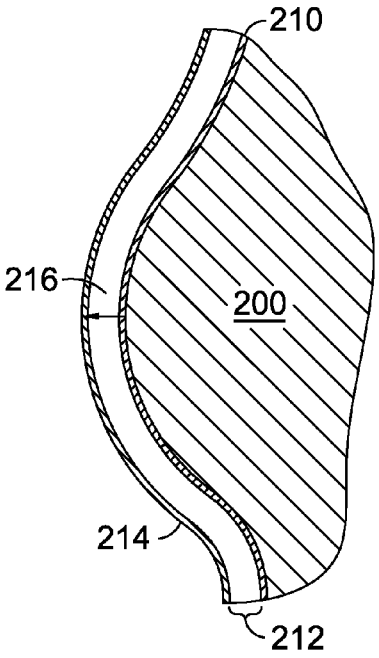
FIG. 2 is a longitudinal section taken from a sport bra illustrating an interior layer, a molded layer, and a exterior layer of the sport bra in an aspect of the present invention.

FIG. 2 depicts a longitudinal section taken through the sport bra 110 of FIG. 1 at approximately the bust point of one of the molded cups 112. As used throughout this application, the term "bust point" is meant to encompass the central area of the molded cup 112 (e.g., the area generally overlying the nipple area of the wearer's breast). Other complementary terms for this area may include the apex of the molded cup 112. As such, the terms "bust point" and "apex" may be used interchangeably herein. FIG. 2 is used to illustrate general features of a sport bra with moisture-transporting molded cups. The features discussed with respect to FIG. 2 may be applicable to any of the FIGS. 3-8 and 13. The skin/body of the wearer is shown at item 200. The longitudinal section illustrates an internal-facing first fabric layer 210 that is adjacent to the skin 200. In general, the first fabric layer 210 may comprise any man-made or natural fiber. Further, the first fabric layer 210 may be manufactured by knitting, including warp or weft knitting, and/or weaving. The first fabric layer has a degree of hydrophilicity. As used throughout this application, the term "hydrophilic" and its derivatives means having an affinity for water or readily absorbing water.

FIG. 2 also depicts a middle layer 212 comprised of a molded material; the middle layer 212 is disposed between the first fabric layer 210 and a second fabric layer 214. The molded material of the middle layer 212 may comprise foam, fibers, yarns, a space fabric, hydrophilic treatments, hydrophobic treatments, injection-molded materials, and/or a combination of these materials. The characteristics of these materials will be explored in greater depth below with respect to FIGS. 3-8 and 13. The middle layer 212 may be comprised of a single layer of material having different zones, or it may be comprised of multiple layers of materials. Further, the middle layer 212 may have a degree of hydrophilicity that is greater than that of the first fabric layer.

FIG. 2 further depicts the second fabric layer 214 that is situated on the external face of the sport bra. Like the first fabric layer 210, the second fabric layer 214 may be comprised of man-made or natural fibers. Likewise, the second fabric layer 214 may be manufactured by knitting, such as warp knitting or weft knitting, and/or weaving the second fabric layer 214. The second fabric layer 214 has a degree of hydrophilicity that is greater than that of the first fabric layer 210 and the middle layer 212. The effect of the varying the hydrophilic properties between the first fabric layer 210, the middle layer 212, and the second fabric layer 214 is to create a hydrophilic gradient that facilitates movement of water or sweat away from the skin 200 of the wearer to the exterior of the sport bra. This is shown by the arrow 216. Further, the second fabric layer 214 may have hydrophilic properties that help to not only draw the sweat away from the skin 200 but to disperse the sweat along the surface of the sport bra. Thus, sweat does not remain localized over the molded bra cups.

Although FIG. 2 depicts the sport bra 110 as having the first fabric layer 210, the middle layer 212, and the second fabric layer 214, it is contemplated that the sport bra 110 of FIG. 1 may comprise, in part, just the middle layer 212 without the first fabric layer 210 and the second fabric layer 214. Straps and/or a closure mechanism may be directly attached to the middle layer 212 to complete construction of the sport bra 110. Any and all such aspects, and any combination thereof, are contemplated as being within the scope of the invention.

Figure 3:
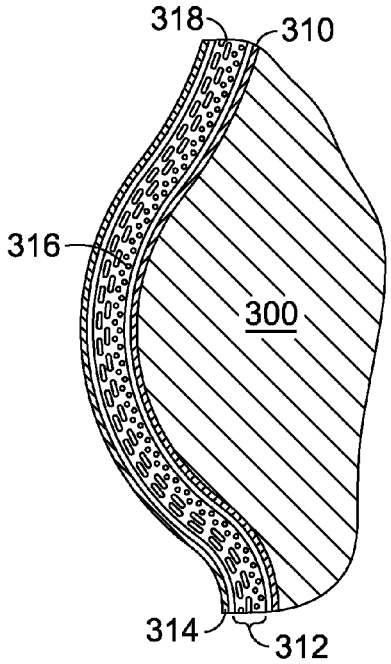
FIG. 3 is a longitudinal section taken from a sport bra illustrating a molded layer comprising a foam with different average cell sizes in an aspect of the present invention.

Turning to FIG. 3, FIG. 3 depicts a longitudinal section taken through the sport bra 110 of FIG. 1 at approximately the bust point of one of the molded cups 112. The skin/body of the wearer is shown at item 300. The longitudinal section illustrates a first fabric layer 310 that is adjacent to the skin 300 and a second fabric layer 314 that is situated on the external face of the sport bra. The properties of the first fabric layer 310 and the second fabric layer 314 are outlined above with respect to FIG. 2 and will not be repeated here. FIG. 3 depicts a middle layer 312 made of a foam material. Although a void or space is shown between the first fabric layer 310 and the middle layer 312 to better illustrate properties of the middle layer 312, the void need not exist in the finished sport bra. Likewise, a void or space is shown between the middle layer 312 and the second fabric layer 314 to better illustrate properties of the middle layer 312, but the void need not exist in the finished sport bra.

The foam material in the middle layer 312 may comprise hydrophilic polyurethane and may be processed using manufacturing techniques common to foams (e.g., forming gas bubbles in a plastic mixture using a blowing agent). Altering the molecular structure, amount, and reaction temperature of the various foam components or blowing agents determines the characteristics of the resulting foam. In one aspect, the foam material of the middle layer 312 comprises different zones, each zone having a predetermined average cell or bubble size. As used throughout this application, cell size may refer to a diameter, surface area, and/or circumference of the cell. Cells may be spherical, ellipsoid, or irregular in shape.

The foam material may comprise a first zone 316 having a first cell size or first average cell size, where the first zone 316 is adjacent to the first fabric layer 310. The foam material may also comprise a second zone 318 located adjacent to the first zone 316 and adjacent to the second fabric layer 314. The second zone 318 has a second cell size or second average cell size that is greater than the first average cell size of the first zone 316. The effect of having a smaller average cell size adjacent to the skin of the wearer and a larger average cell size facing the exterior of the sport bra is to create a diffusion gradient that wicks sweat away from the skin 306 to the exterior of the sport bra.

The demarcation between the first zone 316 and the second zone 318 may be gradual or abrupt. Further, the zones 316 and 318 may be part of a unitary or single layer of foam material used for the middle layer 312. The different zones in the single layer of foam material may be made by varying the molecular structure, amount, and reaction temperature of the components used to make the zones 316 and 318. In another aspect, the first zone 316 may be associated with a first layer of foam material, and the second zone 318 may be associated with a second layer of foam material. The different layers of the foam material may be joined together using, for example, adhesives, spot welding, stitching, ultrasound, light, heat, mechanical retention in a pocket of fabric, and the like. The different layers of foam material may be joined in such a way as to not impede the passage of the sweat from the skin 300 to the exterior of the sport bra. For example, adhesive may be applied only in selected areas or spot fusing may only be applied in selected areas. Although only two layers of foam material are discussed, it is contemplated that the middle layer 312 may be comprised of multiple layers of foam material, each layer having a different cell size with the smallest cell size layer closest to the skin 300 progressing to the largest cell size layer adjacent to the exterior face of the sport bra.

Figure 4:
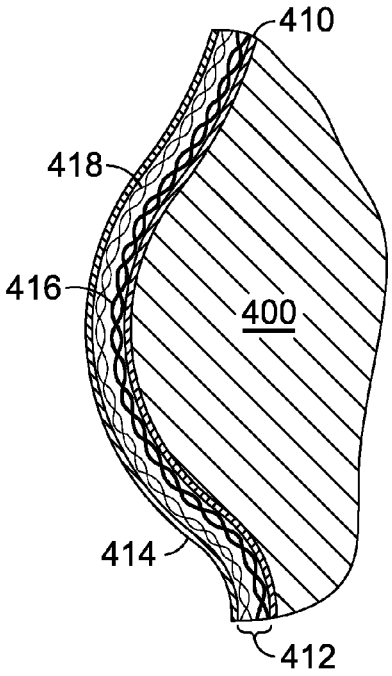
FIG. 4 is a longitudinal section taken from a sport bra illustrating a molded layer comprised of moldable, non-woven fibers in an aspect of the present invention.

Turning to FIG. 4, FIG. 4 depicts a longitudinal section taken through the sport bra 110 of FIG. 1 at approximately the bust point of one of the molded cups 112. The skin/body of the wearer is shown at item 400. The longitudinal section illustrates a first fabric layer 410 that is adjacent to the skin 400 and a second fabric layer 414 that is situated on the external face of the sport bra. The properties of the first fabric layer 410 and the second fabric layer 414 were outlined above with respect to FIG. 2 and will not be repeated here. FIG. 4 depicts a middle layer 412 comprising non-woven, moldable fibers having different DPFs.

The non-woven, moldable fibers that make up the middle layer 412 may comprise natural or cellulosic fibers and/or man-made fibers. Exemplary natural fibers may comprise cotton, silk, wool, flax, and/or hemp. Exemplary man-made fibers may comprise polyester, nylon, rayon, spandex, and/or rubber. The non-woven moldable fibers may be heat molded to form the molded cup. Prior to heat molding, the fibers may be arranged so that thicker fibers are situated in a thick fiber zone 416 that is adjacent to the first fabric layer 410 and the skin 400, and thinner fibers are situated in a thin fiber zone 418 that is adjacent to the second fabric layer 414. When fibers are thin, there is a greater amount of surface area associated with a group of fibers within a predetermined area (e.g., thin fiber zone 418). Conversely, when fibers are thick, there is a smaller amount of surface area associated with a group of fiber within a predetermined area (e.g., thick fiber zone 416). The arrangement of the zones 416 and 418 is configured to facilitate movement of sweat away from the skin 400 via capillary action. Since the thin fiber zone 418 has a greater amount of surface area, the sweat is effectively transported from the thick fiber zone 416 to the thin fiber zone 418.

Although FIG. 4 depicts the thick fiber zone 416 and the thin fiber zone 418, it is contemplated that there may be multiple zones within a single layer of material with each zone having fibers of a predetermined average DPF. Fibers having a larger DPF or larger average DPF are arranged closer to the skin 400, and fibers having a smaller DPF or smaller average DPF are arranged closer to the exterior surface of the sport bra. Further, the middle layer 412 of FIG. 4 may actually comprise multiple layers that are attached to one another via use of adhesives, stitching, mechanical retention in a pocket, spot fusing, heat, and the like. Again, fibers having a larger average DPF are arranged closer to the skin 400, and fibers having a smaller average DPF are arranged closer to the exterior surface of the sport bra. The attachments between the different layers may occur in selective areas so as not to impede the flow of sweat from the skin 400 to the second fabric layer 414.

Figure 5:
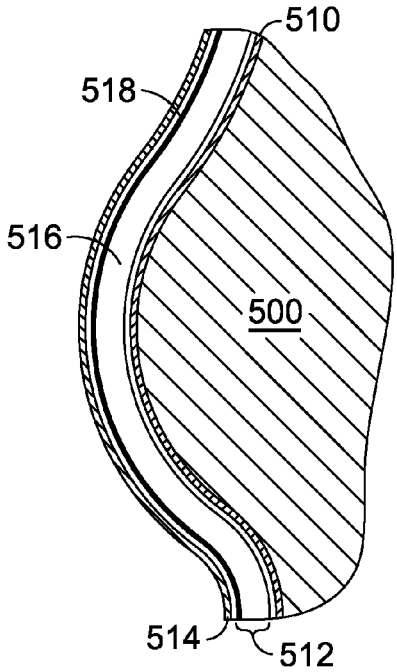
FIG. 5 is a longitudinal section taken from a sport bra illustrating a molded layer comprised of injection-molded materials and a hydrophilic layer in an aspect of the present invention.

Turning to FIG. 5, FIG. 5 depicts a longitudinal section taken through the sport bra 110 of FIG. 1 at approximately the bust point of one of the molded cups 112. The skin/body of the wearer is shown at item 500. The longitudinal section illustrates a first fabric layer 510 that is adjacent to the skin 500 and a second fabric layer 514 that is situated on the external face of the sport bra. The properties of the first fabric layer 510 and the second fabric layer 514 are similar to the fabric layers discussed above and will not be repeated here. FIG. 5 also depicts a middle layer 512 made up of an injection-molded zone 516 and a hydrophilic layer or overlay 518. Although a void or space is shown between the first fabric layer 510 and the middle layer 512 to better illustrate properties of the middle layer 512, the void need not exist in the finished sport bra. Likewise, a void or space is shown between the middle layer 512 and the second fabric layer 514 to better illustrate properties of the middle layer 512, but the void need not exist in the finished sport bra.

The injection-molded zone 516 may be comprised of water-permeable polyurethane materials having properties that impart a flexible molded shape to the molded cup subsequent to injection molding the materials. The injection-molded zone may have a first degree of hydrophilicity. Subsequent to injection molding the injection-molded zone 516, a hydrophilic treatment may be applied to the exterior surface of the injection-molded zone 516 to generate the hydrophilic layer 518. The hydrophilic layer 518 has a second degree of hydrophilicity that is greater than the injection-molded zone 516. Sweat is transported along the hydrophilic gradient from the skin 500 through the injection-molded zone 516 and the hydrophilic layer 518 to the second fabric layer 514. In another aspect of the invention, hydrophobic treatments may be utilized in order to achieve a desired hydrophilic gradient.

Figure 6:
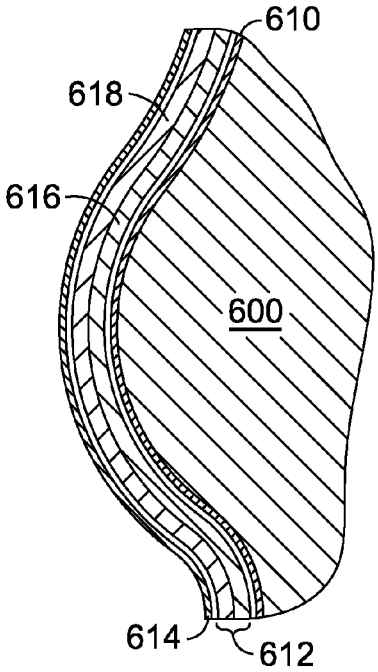
FIG. 6 is a longitudinal section taken from a sport bra illustrating a molded layer comprised of injection-molded materials having different hydrophilic properties in an aspect of the present invention.

FIG. 6 depicts a variation of the injection-molded zone 516 of FIG. 5. FIG. 6 depicts a longitudinal section taken through the sport bra 110 of FIG. 1 at approximately the bust point of one of the molded cups 112. The skin/body of the wearer is shown at item 600. The longitudinal section illustrates a first fabric layer 610 that is adjacent to the skin 600 and a second fabric layer 614 that is situated on the external face of the sport bra. The properties of the first fabric layer 610 and the second fabric layer 614 are similar to the fabric layers discussed above and will not be repeated here. FIG. 6 also depicts a middle layer 612 made up of a first injection-molded zone 616 and a second injection-molded zone 618. Although a void or space is shown between the first fabric layer 610 and the middle layer 612 to better illustrate properties of the middle layer 612, the void need not exist in the finished sport bra. Likewise, a void or space is shown between the middle layer 612 and the second fabric layer 614 to better illustrate properties of the middle layer 612, but the void need not exist in the finished sport bra.

Differential injection molding techniques may be used to generate a unitary or single layer middle layer 612 having the different injection-molded zones 616 and 618. For instance, the injection-molded zone 616 may be made using a first type of injection molding material and/or chemical additive to impart a first degree of hydrophilicity to the injection-molded zone 616. The injection-molded zone 618 may be made using a second type of injection molding material and/or chemical additive to impart a second degree of hydrophilicity to the injection-molded zone 618, where the second degree of hydrophilicity is greater than the first degree of hydrophilicity. This creates a hydrophilic gradient that facilitates movement of sweat away from the skin 600 to the second fabric layer 614.

In another aspect, the middle layer 612 may be comprised of multiple, different layers of injection-molded materials with each layer having a different hydrophilicity. Again, the different hydrophilic properties of the different layers may be generated using different injection molding materials, injection-molding settings, and/or chemical additives. The different layers may be attached to each other using the selective application of adhesives, stitching, mechanical retention in a fabric pocket, spot fusing, heat, and the like as described above. The layers may be arranged so that less hydrophilic layers are situated close to the skin 600 and more hydrophilic layers are arranged adjacent to the second fabric layer 614, thus creating a hydrophilic gradient that facilitates movement of sweat away from the skin 600 to the second fabric layer 614.

Figure 7:
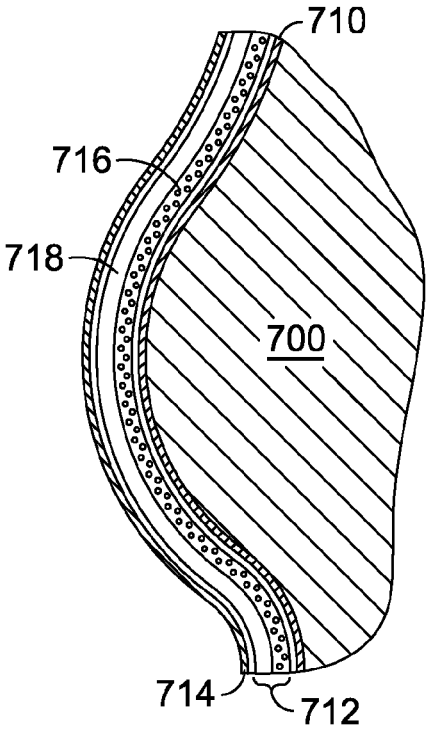
FIG. 7 is a longitudinal section taken from a sport bra illustrating a molded layer comprised of a foam layer and an injection-molded layer in an aspect of the present invention.

Turning to FIG. 7, FIG. 7 depicts a longitudinal section taken through the sport bra 110 of FIG. 1 at approximately the bust point of one of the molded cups 112. The skin/body of the wearer is shown at item 700. The longitudinal section illustrates a first fabric layer 710 that is adjacent to the skin 700 and a second fabric layer 714 that is situated on the external face of the sport bra. The properties of the first fabric layer 710 and the second fabric layer 714 are similar to the fabric layers discussed above and will not be repeated here. FIG. 7 also depicts a middle layer 712 made up of a foam zone 716 and an injection-molded zone 718. Although a void or space is shown between the first fabric layer 710 and the middle layer 712 to better illustrate properties of the middle layer 712, the void need not exist in the finished sport bra. Likewise, a void or space is shown between the middle layer 712 and the second fabric layer 714 to better illustrate properties of the middle layer 712, but the void need not exist in the finished sport bra.

The foam zone 716 may comprise hydrophilic polyurethane and may be generated using manufacturing techniques common to foams (e.g., forming gas bubbles in a plastic mixture using a blowing agent). Manufacturing parameters may be adjusted so that the foam zone 716 has a first cell size or first average cell size imparting a first degree of hydrophilicity. The injection-molded zone 718 may be comprised of water-permeable polyurethane materials having a second degree of hydrophilicity that is greater than the first degree of hydrophilicity. This creates a hydrophilic gradient between the foam zone 716 and the injection-molded zone 718. Sweat is wicked away from the skin 700 by moving along the hydrophilic gradient. The foam zone 716 is attached to the injection-molded zone 718 by applying heat, ultrasound, adhesives, etc. to selected portions of the interface between the foam zone 716 and the injection-molded zone 718.

Although FIG. 7 depicts the foam zone 716 as being adjacent to the first fabric layer 710 and the injection-molded zone 718 as being adjacent to the second fabric layer 714, it is also contemplated that an injection-molded zone may be adjacent to first fabric layer 710 and a foam zone may be adjacent to the second fabric layer 714. Manufacturing parameters may be adjusted such that the hydrophilic gradient is maintained and sweat is wicked away from the skin 700. Further, although just the foam zone 716 and the injection-molded zone 718 are depicted, it is contemplated that a plurality of zones may exist comprising any combination of foam zones and injection-molded zones having a hydrophilic gradient from the skin 700 to the second fabric layer 714. Additionally, the plurality of zones may comprise a combination of foam zones, injection-molded zones, hydrophilic treatments or overlays, and/or hydrophobic treatments or overlay to create a hydrophilic gradient from the skin 700 to the second fabric layer 714. Any and all such aspects, and any combination thereof, are contemplated as being within the scope of the invention.

Figure 8:
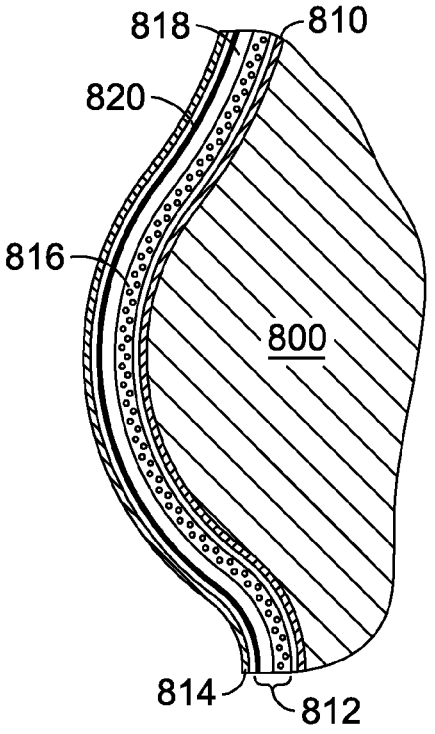
FIG. 8 is a longitudinal section taken from a sport bra illustrating a molded layer comprised of a foam layer, an injection-molded layer, and a hydrophilic overlay in an aspect of the present invention.

Turning to FIG. 8, FIG. 8 depicts a longitudinal section taken through the sport bra 110 of FIG. 1 at approximately the bust point of one of the molded cups 112. The skin/body of the wearer is shown at item 800. The longitudinal section illustrates a first fabric layer 810 that is adjacent to the skin 800 and a second fabric layer 814 that is situated on the external face of the sport bra. The properties of the first fabric layer 810 and the second fabric layer 814 are similar to the fabric layers discussed above and will not be repeated here. FIG. 8 also depicts a middle layer 812 made up of a foam zone 816, an injection-molded zone 818, and a hydrophilic layer 820. Although a void or space is shown between the first fabric layer 810 and the middle layer 812 to better illustrate properties of the middle layer 812, the void need not exist in the finished sport bra. Likewise, a void or space is shown between the middle layer 812 and the second fabric layer 814 to better illustrate properties of the middle layer 812, but the void need not exist in the finished sport bra.

As mentioned, the middle layer 812 comprises the foam zone 816, the injection-molded zone 818, and the hydrophilic layer 820. The properties of the materials used to generate the foam zone 816, the injection-molded zone 818, and the hydrophilic layer 820 are adjusted so that a hydrophilic gradient is created between the first fabric layer 810 and the second fabric layer 814 (i.e., the hydrophilic layer 820 has a higher degree of hydrophilicity than the injection-molded zone 818, which, in turn, has a higher degree of hydrophilicity than the foam zone 816). Additionally, a hydrophobic layer may additionally be used to create the hydrophilic gradient.

Figure 13:
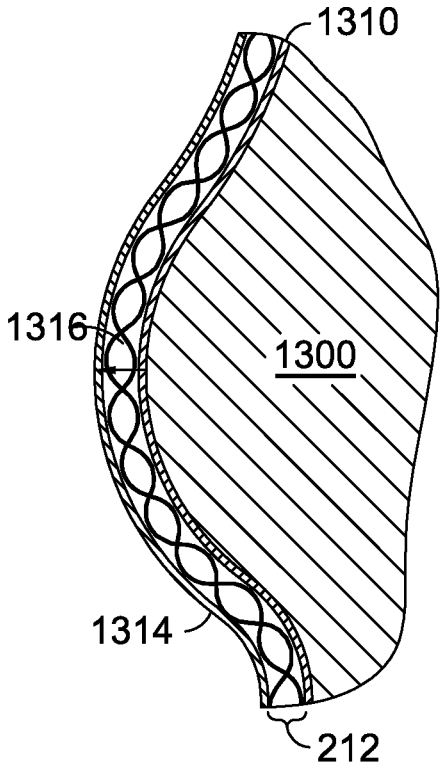
FIG. 13 is a longitudinal section taken from a sport bra illustrating a molded layer comprised of a spacer fabric in an aspect of the present invention.

FIG. 13 depicts a longitudinal section taken through the sport bra 110 of FIG. 1 at approximately the bust point of one of the molded cups 112. The skin/body of the wearer is shown at item 1300. The longitudinal section illustrates a first fabric layer 1310 that is adjacent to the skin 1300 and a second fabric layer 1314 that is situated on the external face of the sport bra 110. The properties of the first fabric layer 1310 and the second fabric layer 1314 are similar to the fabric layers discussed above and will not be repeated here. FIG. 13 also depicts a middle layer 1316 comprised of a spacer fabric. The spacer fabric may be knitted or woven using either natural fibers and/or man-made fibers.

The spacer fabric that makes up the middle layer 1316 may be knitted or woven separately from the first fabric layer 1310 and the second fabric layer 1314. Alternatively, the spacer fabric that makes up the middle layer 1316 may be integrally knitted or woven with the first fabric layer 1310 and/or the second fabric layer 1314. The first fabric layer 1310 may be constructed of yarns and/or fibers having a larger DPF (e.g., DPF greater than 1.04), and the second fabric layer 1314 may be constructed of yarns and/or fibers having a smaller DPF (e.g., DPF less than 1.04). The DPF of the fibers that make up the spacer fabric are selected so as not to impede the moisture flow from the first fabric layer 1310 to the second fabric layer 1314. As well, the type of fiber selected for the middle layer 1316 along with the compactness of the weave are selected so as not to impede the moisture flow from the first fabric layer 1310 to the second fabric layer 1314.

Although not shown, it is also contemplated that the middle layer of the molded cup may comprise yarns made up of either man-made and/or natural materials. In one aspect, the yarns may comprise tie-yarns that extend from an internal-facing first fabric layer to an external-facing second fabric layer.

FIGS. 3-8 and 13 provide some representative examples of arrangements of different zones/layers and materials in the molded bra cup. It is contemplated that the foams, fibers, injection-molded materials, yarns, spacer fabrics, hydrophobic layers, and/or hydrophilic layers used to create the zones/layers may be combined in any order as long as a hydrophilic gradient is created between the first fabric layer and the second fabric layer that facilitate movement of sweat between the first fabric layer and the second fabric layer.

Figure 9:
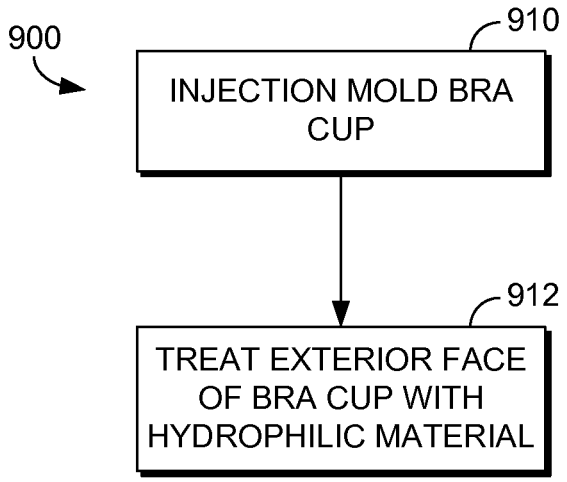
FIGS. 9-12 depict exemplary flow diagrams illustrating methods of creating a moisture-transporting molded cup using different materials in aspects of the present invention.

Turning now to FIG. 9, FIG. 9 depicts a flow diagram of an exemplary process 900 of making a moisture-transporting molded bra cup for a sport bra. At a step 910, the molded bra cup is injection molded using water-permeable materials, such as water-permeable polyurethanes. Materials, chemical additives, and/or injection-molding settings may be selected to impart a first degree of hydrophilicity to the molded bra cup. The molded bra cup has an exterior face and an interior face facing a skin surface of a wearer when the sport bra is worn.

Subsequent to injection molding the molded bra cup, the exterior face of the molded bra cup is treated with a hydrophilic material at a step 912. The hydrophilic material has a second degree of hydrophilicity that is greater than the first degree of hydrophilicity. This creates a hydrophilic gradient that facilitates movement of sweat/water away from the skin surface to the exterior of the sport bra. Hydrophilic material may also be used to treat the molded bra cup (either on an internal face or an external face) so long as a hydrophilic gradient is created.

Figure 10:
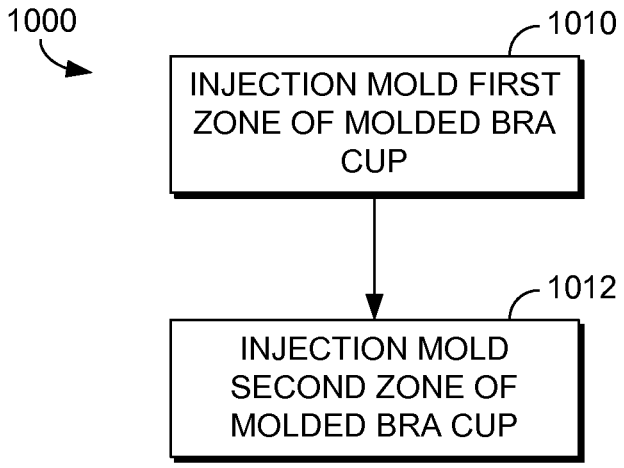

FIG. 10 depicts a flow diagram of another exemplary process 1000 for making a moisture-transporting molded bra cup for a sport bra. At a step 1010, a first zone of the molded bra cup is created using injection-molding techniques and water-permeable materials such as water-permeable polyurethane. The first zone of the molded bra cup has a first degree of hydrophilicity and is substantially adjacent to a skin surface of a wearer when the sport bra is worn.

At a step 1012, a second zone of the molded bra cup is created using injection-molding techniques. Again, water-permeable materials such as water-permeable polyurethane may be used to create the second zone. The second zone has a second degree of hydrophilicity that is greater than the first zone. This may be because of the type of injection-molding material used, injection-molding settings, and/or chemical additives applied to the injection-molding material. The second zone comprises an exterior face of the molded sport bra cup.

The second zone may be further treated with a hydrophilic overlay having a third degree of hyrdrophilicity as compared to the first and second degrees of hydrophilicity. The first and second zones may be part of a unitary piece of material and may be created using differential injection-molding techniques. In another aspect, the first zone may comprise a first layer of material, and the second zone may comprise a second layer of material. The layers may be selectively attached to one another using heat, stitching, mechanical retention in a pocket, adhesives, ultrasound, and the like. The layers are attached in such a way so as not to impede the flow of sweat/water from the skin to the exterior surface of the bra.

Figure 11:
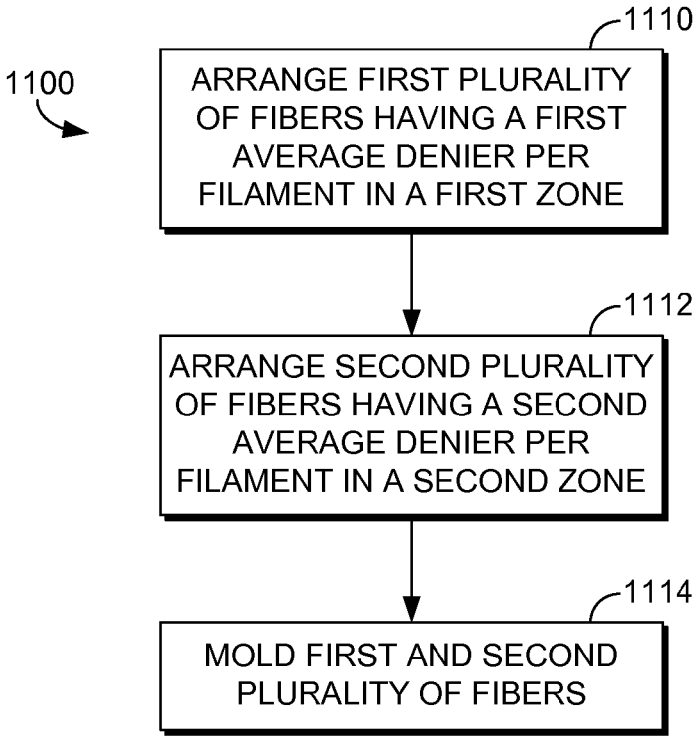

FIG. 11 depicts a flow diagram of another exemplary process 1100 for making a moisture-transporting molded bra cup for a sport bra. At a step 1110, a first plurality of fibers is arranged in a first zone; the first plurality of fibers has a first DPF or a first average DPF. The first zone is substantially adjacent to a skin surface of a wearer when the sport bra is worn. At a step 1112, a second plurality of fibers is arranged in a second zone. The second plurality of fibers has a second DPF or a second average DPF, and the second average DPF is less than the first average DPF. The second zone comprises an exterior face of the molded bra cup. The first and second pluralities of fibers may comprise natural and/or man-made fibers that are moldable.

At a step 1114, the first plurality of fibers and the second plurality of fibers are molded to form the moisture-transporting molded bra cup. Heat may be used to mold the bra cup. Other ways of molding the bra cup may also be used such as pressure, chemicals, light, and the like.

Figure 12:
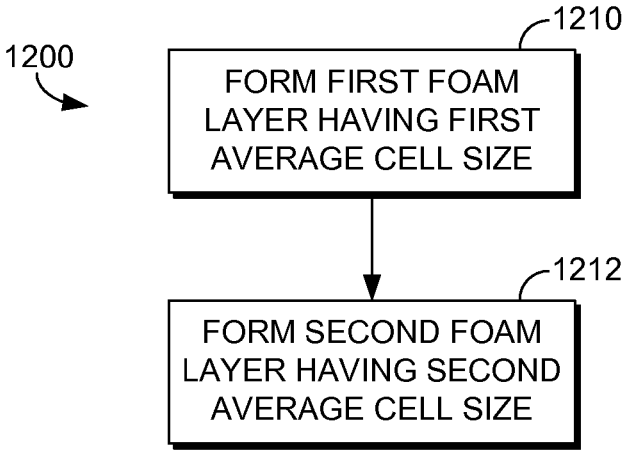

FIG. 12 depicts yet another flow diagram of an exemplary process for making a moisture-transporting molded bra cup for a sport bra. At a step 1210, a first foam layer is formed and molded having a first cell size or first average cell size. The first foam layer is substantially adjacent to a skin surface of a wearer when the sport bra is worn. At a step 1212, a second foam layer is formed and molded having a second cell size or second average cell size; the second average cell size is greater than the first average cell size. The second foam layer comprises an exterior face of the molded bra cup.

The first and second foam layers may comprise polyurethane materials having water-permeable properties. Molecular structure, amounts, and reaction temperatures of the foam components may be altered to create the different cell sizes or different average cell sizes of the first zone and the second zone.

The first and second foam zones may be formed from a single piece of material. Alternatively, the first foam zone may be formed from a first piece of material, and the second foam zone may be formed from a second piece of material. Further, the first and second pieces of materials may be selectively attached to one another so as not to impede water/sweat transport from the skin surface to the exterior of the sport bra.

The present invention has been described in relation to particular examples, which are intended in all respects to be illustrative rather than restrictive. Alternative embodiments will become apparent to those of ordinary skill in the art to which the present invention pertains without departing from its scope. Certain features and subcombinations are of utility and may be employed without reference to other features and subcombinations and are contemplated within the scope of the claims.

What is claimed is:

1. A moisture-transporting molded bra cup for a sport bra, the molded bra cup comprising:

a first zone formed of a foam material having a first average cell size, the first zone substantially adjacent to a skin surface of a wearer when the sport bra is worn; and a second zone formed of a foam material having a second average cell size, the second average cell size greater than the first average cell size, the second zone comprising an exterior face of the molded bra cup.

2. The molded bra cup of claim 1, wherein the first zone and the second zone comprise a water-permeable polyurethane.

3. The molded bra cup of claim 1, wherein the first zone and the second zone comprise a single layer of material.

4. The molded bra cup of claim 1, wherein the first zone comprises a first layer of material and the second zone comprises a second layer of material.

5. The molded bra cup of claim 4, wherein the first layer is selectively attached to the second layer so as not to impede the passage of water from the first zone to the second zone.

6. The molded bra cup of claim 5, wherein the first layer is selectively attached to the second layer using at least one of adhesive, ultrasonic welding, or heat.

7. A process for making a moisture-transporting molded bra cup for a sport bra, the process comprising:

injection molding the molded bra cup using water-permeable materials, the molded bra cup having a first degree of hydrophilicity, the molded bra cup having an exterior face and an interior face facing a skin surface of a wearer when the sport bra is worn;

subsequent to injection molding the molded bra cup, applying a hydrophilic treatment to the exterior face of the molded bra cup, the hydrophilic treatment having a second degree of hydrophilicity that is greater than the first degree of hydrophilicity, and subsequent to applying the hydrophilic treatment to the exterior face of the molded bra cup, affixing an outer fabric layer to the exterior face of the molded bra cup.

8. The process of claim 7, wherein the water-permeable materials comprise water-permeable polyurethane.

9. A process for making a moisture-transporting molded bra cup for a sport bra, the process comprising:

injection molding a first zone of the molded bra cup, the first zone having a first degree of hydrophilicity, the first zone being substantially adjacent to a skin surface of a wearer when the sport bra is worn; and injection molding a second zone of the molded bra cup, the second zone comprising an exterior face of the molded bra cup, wherein the second zone of the molded bra cup overlays the first zone of the molded bra cup in its entirety, the second zone having a second degree of hydrophilicity that is greater than the first degree of hydrophilicity.

10. The process of claim 9, further comprising:

treating the exterior face of the molded bra cup with a hydrophilic material having a third degree of hydrophilicity that is greater than the second degree of hydrophilicity.

11. The process of claim 9, wherein the first zone and the second zone of the molded bra cup comprise a unitary piece of material.

12. The process of claim 9, wherein the first zone comprises a first layer of material and the second zone comprises a second layer of material.

13. The process of claim 12, wherein the first layer is selectively attached to the second layer so as not to impede the passage of sweat from the first layer to the second layer.

14. A moisture-transporting molded sport bra, the molded sport bra comprising:

a first fabric layer that is adjacent to a skin surface of a wearer when the molded sport bra is worn, the first fabric layer comprised of a hydrophilic material having a first degree of hydrophilicity;

a second fabric layer that comprises an exterior face of the molded sport bra when worn, the second fabric layer comprised of a hydrophilic material having a second degree of hydrophilicity that is greater than the first degree of hydrophilicity; and a unitary and continuous molded layer disposed between the first fabric layer and the second fabric layer, the molded layer comprised of a material having a third degree of hydrophilicity that is between the first and second degrees of hydrophilicity associated with the first fabric layer and the second fabric layer respectively, wherein a hydrophilic gradient is formed from the first fabric layer to the second fabric layer.

15. The molded sport bra of claim 14, wherein the molded layer comprises non-woven, moldable fibers of variable diameter.

16. The molded sport bra of claim 15, wherein fibers having a first average denier per filament are arranged adjacent to the first fabric layer, and wherein fibers having a second average denier per filament are arranged adjacent to the second fabric layer.

17. The molded sport bra of claim 16, wherein the first average denier per filament is greater than the second average denier per filament.

18. The molded sport bra of claim 17, wherein the fibers are arranged prior to molding the fibers.

19. The molded sport bra of claim 14, wherein the molded layer comprises polyurethane foam.

20. The molded sport bra of claim 19, wherein the polyurethane foam comprises a first zone having a first average cell size, the first zone adjacent to the first fabric layer, and wherein the polyurethane foam comprises a second zone having a second average cell size, the second zone adjacent to the second fabric layer.

21. The molded sport bra of claim 20, wherein the first average cell size is smaller than the second average cell size.

22. The molded sport bra of claim 14, wherein the molded layer is injection-molded layer.

23. The molded sport bra of claim 22, wherein the injection-molded layer is comprised of water-permeable polyurethane.

24. The molded sport bra of claim 22, wherein the molded layer comprises a first face adjacent to the first fabric layer and a second face adjacent to the second fabric layer, and wherein the second face further comprises a hydrophilic treatment such that the hydrophilic treatment is disposed between the second face of the molded layer and the second fabric layer.

25. The molded sport bra of claim 24, wherein the hydrophilic treatment has a fourth degree of hydrophilicity that is greater than the third degree of hydrophilicity.

26. A process for making a moisture-transporting molded bra cup for a sport bra, the process comprising:

arranging a first plurality of fibers in a first zone, the first plurality of fibers having a first average denier per filament, the first zone being substantially adjacent to a skin surface of a wearer when the sport bra is worn;

arranging a second plurality of fibers in a second zone, the second zone adjacent to the first zone and comprising an exterior face of the molded bra cup, the second plurality of fibers having a second average denier per filament, the second average denier per filament being less than the first average denier per filament; and molding the first plurality of fibers and the second plurality of fibers to form the moisture-transporting molded bra cup.

27. The process of claim 26, wherein the molding comprises applying heat to the first plurality of fibers and the second plurality of fibers.

28. A moisture-transporting molded sport bra cup, the molded sport bra cup comprising:

an interior zone comprising a first set of non-woven, moldable fibers, each fiber of the first set of non-woven, moldable fibers having a first average denier per filament, the interior zone being substantially adjacent to a skin surface of a wearer when the molded sport bra cup is worn; and an exterior zone comprising a second set of non-woven, moldable fibers, each fiber of the second set of non-woven, moldable fibers having a second average denier per filament, the second average denier per filament being less than the first average denier per filament.

29. The molded sport bra cup of claim 28, wherein the first and second sets of non-woven, moldable fibers comprise at least one of man-made fibers or natural fibers.

30. The molded sport bra cup of claim 29, wherein the man-made fibers comprise at least one of polyester, nylon, rayon, spandex, or rubber, and wherein the natural fibers comprise at least one of cotton, silk, wool, flax, or hemp.

31. An injection-molded moisture-transporting sport bra cup, the sport bra cup comprising:

a first injection-molded zone having a first degree of hydrophilicity, the first injection-molded zone being substantially adjacent to a skin surface of a wearer when the sport bra cup is worn; and a second injection-molded zone having a second degree of hydrophilicity, the second degree of hydrophilicity being greater than the first degree of hydrophilicity, the second injection-molded zone comprising an exterior face of the sport bra cup.

32. The sport bra cup of claim 31, wherein the first injection-molded zone and the second injection-molded zone are comprised of water-permeable polyurethane.

33. The sport bra cup of claim 31, wherein the first injection-molded zone and the second injection-molded zone comprise a single layer.

34. The sport bra cup of claim 31, wherein the first injection-molded zone and the second injection-molded zone comprise different layers.

35. The sport bra cup of claim 34, wherein the first injection-molded zone is selectively attached to the second injection-molded zone so as not to impede the passage of sweat.

36. A moisture-transporting molded sport bra cup, the sport bra cup comprising:

a first foam layer having a first degree of hydrophilicity, the first foam layer being substantially adjacent to a skin surface of a wearer when the sport bra cup is worn; and a second injection-molded layer having a second degree of hydrophilicity, the second degree of hydrophilicity being greater than the first degree of hydrophilicity, the second injection-molded layer comprising an exterior face of the sport bra cup, wherein the second injection-molded layer is selectively attached to the first foam layer.

37. A moisture-transporting molded sport bra cup, the sport bra cup comprising:

a first injection-molded layer having a first degree of hydrophilicity, the first injection-molded layer being substantially adjacent to a skin surface of a wearer when the sport bra cup is worn; and a second foam layer having a second degree of hydrophilicity, the second degree of hydrophilicity being greater than the first degree of hydrophilicity, the second foam layer comprising an exterior face of the sport bra cup, wherein the second foam layer is selectively attached to the first injection-molded layer.

38. A moisture-transporting molded sport bra cup, the sport bra cup comprising:

a first foam layer having a first degree of hydrophilicity, the first foam layer being substantially adjacent to a skin surface of a wearer when the sport bra cup is worn;

a second injection-molded layer having a second degree of hydrophilicity, the second degree of hydrophilicity being greater than the first degree of hydrophilicity, the second injection-molded layer comprising an exterior face of the sport bra cup, the second injection-molded layer being selectively attached to the first foam layer; and a third layer comprised of a material having a third degree of hydrophilicity, the third degree of hydrophilicity being greater than the second degree of hydrophilicity, the third layer exterior to the second injection-molded layer, wherein the third layer is adherent to the second injection-molded layer.

39. A process for making a moisture-transporting sport bra cup for a sport bra, the process comprising:

forming a first foam zone having a first average cell size, the first foam zone being substantially adjacent to a skin surface of a wearer when the sport bra is worn; and forming a second foam zone having a second average cell size, the second average cell size being greater than the first average cell size, the second foam zone comprising an exterior face of the molded bra cup.

40. The process of claim 39, wherein the first foam zone and the second foam zone comprise a single layer of material.

41. The process of claim 39, wherein the first foam zone comprises a first layer of material, and wherein the second foam zone comprises a second layer of material.

42. The process of claim 41, wherein the first layer of material is selectively attached to the second layer of material.

* * * * *